US006040099A

United States Patent [19]

Hanami et al.

[11] Patent Number: 6,040,099

[45] **Date of Patent: *Mar. 21, 2000**

[54] ELECTROPHOTOGRAPHIC PHOTOSENSITIVE MATERIAL

[75] Inventors: Nobuyuki Hanami, Matsudo; Junichi Kishi, Tokyo; Yoichi Kawamorita, Yokohama; Takao Soma, Sagamihara, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/584,714

[22] Filed: Jan. 11, 1996

Related U.S. Application Data

[63] Continuation of application No. 08/234,554, Apr. 28, 1994, abandoned.

[30] Foreign Application Priority Data

Apr. 30, 1993 [JP] Japan ..... 5-124817

[51] Int. Cl.[7] ..... G03G 5/147; G03G 5/05

[52] U.S. Cl. ..... 430/66; 430/67; 430/58.2

[58] Field of Search ..... 430/66, 67, 96, 430/58.2

[56] References Cited

U.S. PATENT DOCUMENTS 4,716,091 12/1987 Yoshihara et al. ..... 430/66
4,962,008 10/1990 Kimura et al. ..... 430/66
5,208,127 5/1993 Terrell et al. ..... 430/66
5,254,423 10/1993 Mayama et al. ..... 430/66
5,357,320 10/1994 Kashimura et al. ..... 430/67

OTHER PUBLICATIONS

CRC Handbook, 66th edition, IUPAC Rule A–4, p. C–5, 1985.

*Primary Examiner*—Christopher D. Rodee
*Attorney, Agent, or Firm*—Fitzpatrick, Cella, Harper & Scinto

[57] ABSTRACT

An electrophotographic photosensitive member according to the present invention includes: a photosensitive layer formed on an electroconductive support member thereof, wherein a surface layer of the photosensitive member contains a silicon denatured polycarbonate copolymer and a silicon-type graft polymer. An electrophotographic photosensitive apparatus according to the present invention includes: an electrophotographic photosensitive member, the surface layer of which contains a silicon denatured polycarbonate copolymer and a silicon-type graft polymer; a latent image forming unit for forming an electrostatic latent image on the electrophotographic photosensitive member; a developing unit for forming a toner image by developing the electrophotographic photosensitive member, on which the electrostatic image has been formed, with a toner; and, optimally, a cleaning unit for cleaning the electrophotographic photosensitive member.

7 Claims, 1 Drawing Sheet

ELECTROPHOTOGRAPHIC PHOTOSENSITIVE MATERIAL

This application is a continuation of application Ser. No. 08/234,554 filed Apr. 28, 1994, now abandoned.

BACKGROUND OF THE INVENTION

1. Field of the Invention

The present invention relates to an electrophotographic photosensitive member and an electrophotographic apparatus using the electrophotographic photosensitive member.

2. Description of the Prior Art

As photoconductive material of an electrophotographic photosensitive member, inorganic photoconductive material exemplified by selenium, cadmium sulfide and zinc sulfide has been used. On the other hand, organic photoconductive material (OPC) exemplified by polyvinyl carbazole, oxadiazole and phthalocyanine has advantages in pollution-free characteristics and excellent producibility as compared with the inorganic photoconductive material. However, OPC suffers from unsatisfactory sensitivity.

The electrophotographic photosensitive member, of course, must have a predetermined sensitivity, electric characteristics and optical characteristics to be adaptable to an electrophotographic process to which it is applied. In particular, a photosensitive member, which can be used repeatedly, must have durability against electrical and mechanical forces, such as corona charge, toner development, transference onto paper and a cleaning process which is applied to the surface thereof. Specifically, the photosensitive member must have durability against deterioration in its sensitivity and potential and increases in its residual potential due to degradation which occurs due to ozone generated at the time of corona charging, wear and/or damage of the surface due to sliding and abrasion.

Since the surface of the photosensitive member is formed with resin, the characteristic of the resin is an important factor. Therefore, resins exhibiting excellent durability have been desired. Recently, polycarbonate (hereinafter called "bisphenol A-type polycarbonate") containing bisphenol A as the skeleton thereof has been investigated as a resin capable of satisfying the foregoing desire to serve as a binder for a surface layer. However, the bisphenol A-type polycarbonate cannot satisfy all required electrophotographic characteristics, resulting in the following problems which remain unresolved:

(1) Bisphenol A-type polycarbonate has satisfactory solubility with respect to only a portion of aliphatic hydrocarbon halides, such as dichloromethane or 1,2-dichloroethane. Since each of the foregoing aliphatic hydrocarbon halides has a low boiling point, a photosensitive member manufactured by using a coating liquid prepared by blending with the foregoing solvent allows the coated surface to be easily brushed. Moreover, it requires a long time to apply the coating liquid.

(2) Even if the problem described in (1) can be improved, the polycarbonate, the main skeleton of which is only the bisphenol A derivative, encounters the problem of generation of solvent cracks. The foregoing problem causes cracks to occur in the surface of the photosensitive member in an electrophotographic copying machine.

Another attempt has been made wherein a substance of a type imparting lubricity is added to the photosensitive layer of the photosensitive member. Such a substance is exemplified by a leveling agent, silicone oil and the like. However, conventional surface property modifying agents suffer from unsatisfactory compatibility with the coating liquid on the photosensitive layer. That incompatibility causes a problem of unsatisfactory effect continuity because the modifying agent is shifted or oozed out onto the surface layer during long term use. What is worse, the surface property modifying agent is liable to readily trap carriers generated due to light, thus causing the residual charge to be increased after the electrophotographic process has been repeated.

Although Teflon powder or the like is sometimes dispersed in the photosensitive layer, the photosensitive layer in which the Teflon powder is dispersed exhibits the problem of unsatisfactory dispersion characteristics, deterioration in its transparency and trapping carriers.

SUMMARY OF THE INVENTION

An object of the present invention is to provide an electrophotographic photosensitive member capable of overcoming the problems experienced with conventional electrophotographic photosensitive members and having (i) improved lubricity, (ii) improved wear resistance, (iii) excellent solvent crack resistance and (iv) excellent deformation resistance and to provide an electrophotographic apparatus having such a electrophotographic photosensitive member.

According to one aspect of the invention, there is provided an electrophotographic photosensitive member comprising, in sequence, an electroconductive support and a photosensitive layer formed on the electroconductive support wherein an outer surface of said photosensitive member contains a silicon denatured polycarbonate copolymer and a silicon-type graft polymer.

According to another aspect of the invention, there is provided an electrophotographic photosensitive member which comprises, in sequence, an electroconductive support and a photosensitive layer wherein an outer surface of said electrophotographic photosensitive member contains a silicon denatured polycarbonate copolymer and a silicon-type graft polymer; latent image forming means for forming an electrostatic latent image on the electrophotographic photosensitive member; developing means for forming a toner image by developing the electrophotographic photosensitive member on which the electrostatic image has been formed, with a toner; and cleaning means for cleaning the electrophotographic photosensitive member.

According to another aspect of the invention, there is provided an electrophotographic photosensitive apparatus comprising: an electrophotographic photosensitive member which comprises in sequence, an electroconductive support and a photosensitive layer, wherein an outer surface of said electrophotographic photosensitive member contains a silicon denatured polycarbonate copolymer and a silicon-type graft polymer providing enhanced lubricity to the surface layer; latent image forming means for forming an electrostatic latent image on said electrophotographic photosensitive member; and developing means for forming a toner image by developing the electrophotographic photosensitive member, on which the electrostatic image has been formed; with a toner wherein said lubricity substantially eliminates excess toner which tends to remain on said electrophotographic photosensitive member after said toner image is transferred.

Other and further objects, features and advantages of the invention will appear more fully from the following detailed description.

DESCRIPTION OF THE PREFERRED EMBODIMENTS

Figure 1:
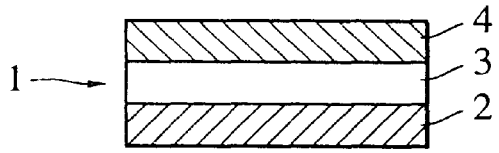
FIG. 1 and FIG. 2 are schematic cross-sectional views of electrophotographic photosensitive members of the present invention.

As illustrated in FIG. 1, the electrophotographic photosensitive member 1 of the present invention has an electroconductive support 2, a photosensitive layer 3 and a surface layer 4.

Figure 2:
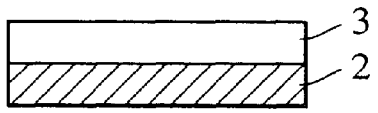

As shown in FIG. 2, in another embodiment, the electrophotographic photosensitive member of the present invention has an electroconductive support 2 and a photosensitive layer 3. The outer surface of the electrophotographic photosensitive member, accordingly, is either photosensitive layer 3 or protective layer 4.

The electrophotographic photosensitive member according to the present invention contains, in the outer surface thereof, silicon denatured polycarbonate copolymer and silicon graft polymer. The outer surface means a photosensitive layer in the case where the photosensitive layer on the electroconductive support member is in the form of a single layer type, the same means a photosensitive layer positioned farthest from the electroconductive support member in the case where the photosensitive layer is in the form of a stacked or laminated type, and the same means a protective layer in the case where the photosensitive layer has a protective layer thereon.

It is preferable that the silicon denatured polycarbonate copolymer for use in the present invention be a type having a structure expressed by the following general formula:

It is preferable that the molecular weight of the copolymer included in the general formula (I) be 5,000 to 150,000 in viscosity average molecular weight, more particularly 10,000 to 100,000. It should be noted that the viscosity average molecular weight in this embodiment is a value measured by using an Ostwald's viscometer.

The copolymer having the structure expressed by general formula (I) is synthesized by interfacial-polycondensating polyhydric phenol and a polyorganosiloxane derivative in the presence of phosgene.

Preferred examples of polyhydric phenol are as follows:

Example Compound 1

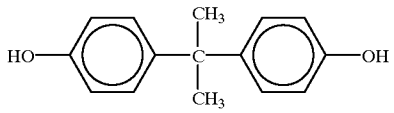

Example Compound 2

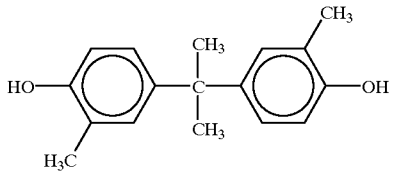

Example Compound 3

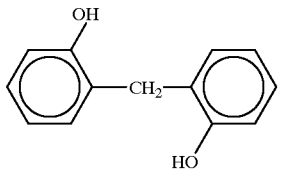

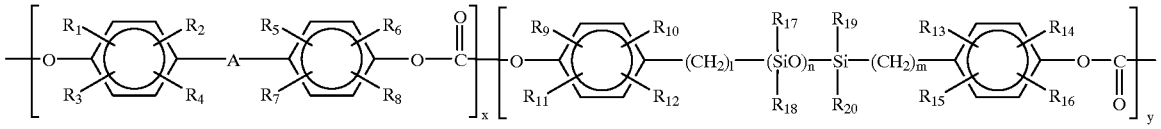

wherein A is a straight chain, branched chain or cyclic alkylidene group, an aryl-substituted alkylene group, a substituted or unsubstituted arylene group, —O—, —S—, —SO—, —$SO_2$ or —CO—, $R_1$ to $R_{16}$ are hydrogen atoms, halogen atoms, substituted or unsubstituted alkyl groups or substituted or unsubstituted aryl groups, $R_{17}$ to $R_{20}$ are substituted or unsubstituted alkyl groups or substituted or unsubstituted phenyl groups, 1, m and n are integers larger than 1 and X and Y are copolymerization ratios.

It is preferable that A in general formula (I) be of a type having 1 to 10 carbon atoms. It is preferable that $R_1$ to $R_{20}$ be of a type having 1 to 4 carbon atoms. It is preferable that 1 and m be an integer 2 to 4. It is preferred that n be an integer from 1 to 500, more preferably 10 to 200.

It is preferable that the sum of X and Y is 100, and that the X and Y components are used at an X:Y ratio ranging from 99.5:0.5 to 10:90, more preferably X>Y, and most preferably X:Y ranges from 99:1 to 80:20. If X is smaller than Y, the mechanical strength deteriorates. If X is excessively larger than Y, the lubricity of the photosensitive member deteriorates.

-continued

Example Compound 4

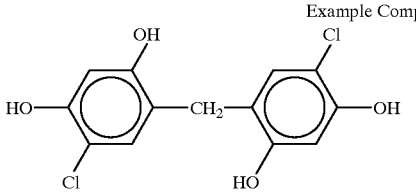

Example Compound 5

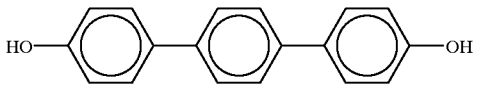

Example Compound 6

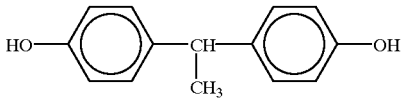

-continued

Example Compound 7

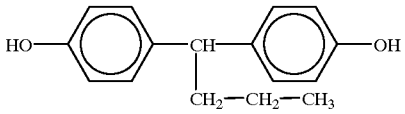

Example Compound 8

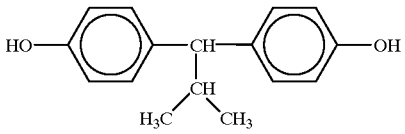

Example Compound 9

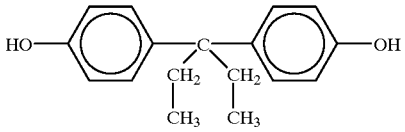

Example Compound 10

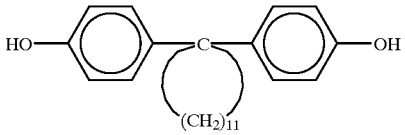

Example Compound 11

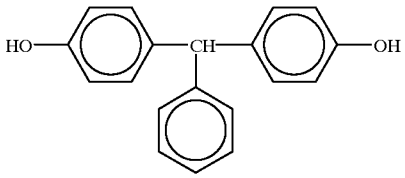

Example Compound 12

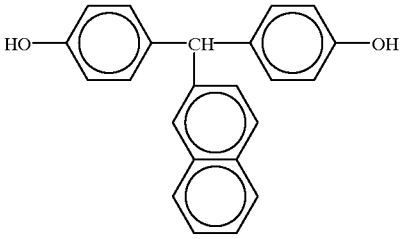

Example Compound 13

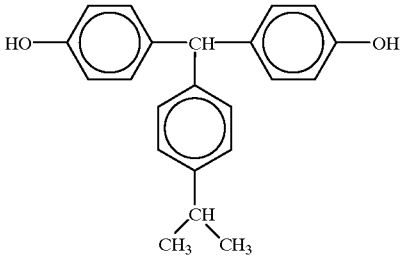

Example Compound 14

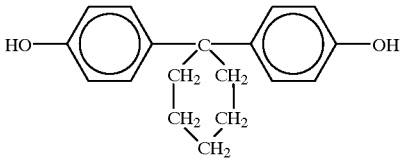

-continued

Example Compound 15

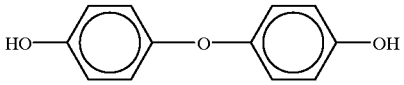

Example Compound 16

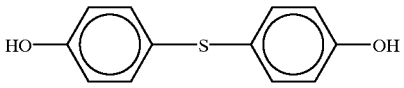

Example Compound 17

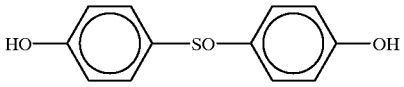

Example Compound 18

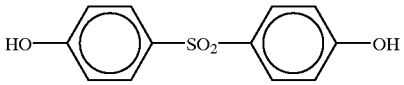

Example Compound 19

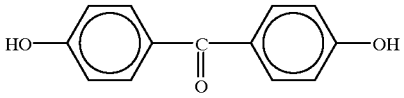

Example Compound 20

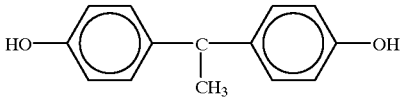

Example Compound 21

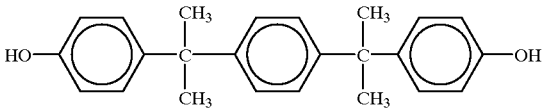

Example Compound 22

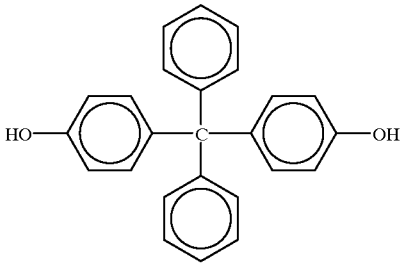

Preferred examples of the polyorganosiloxane derivative are as follows:

Example Derivative 1

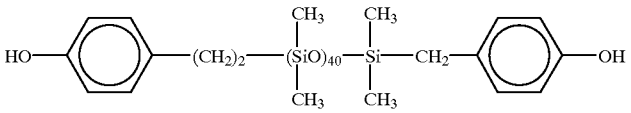

Example Derivative 2

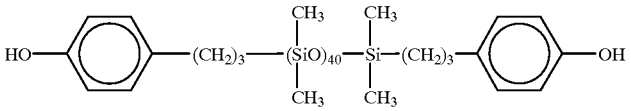

Example Derivative 3

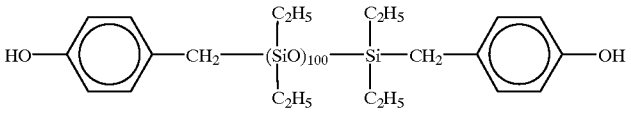

Example Derivative 4

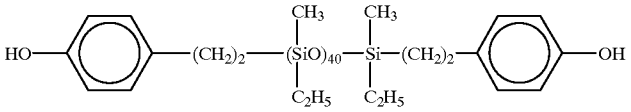

Example Derivative 5

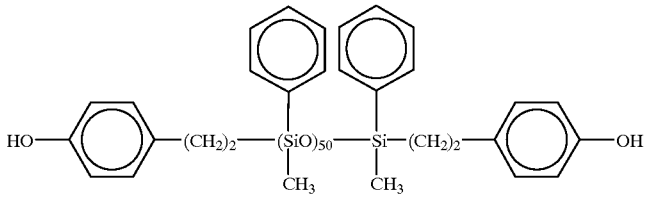

Example Derivative 6

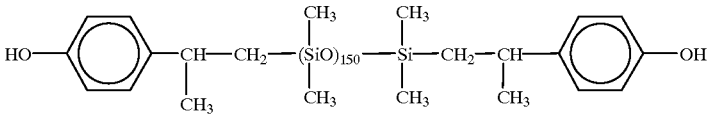

The silicon denatured polycarbonate copolymer for use in the present invention may be synthesized by copolymerizing with a third component in addition to the polyhydric phenol and the polyorganosiloxane.

It is preferable that the quantity of the contained silicon denatured polycarbonate copolymer be 1 to 30 wt % with respect to binder resin in the surface layer, more preferably 1 to 10 wt %, most preferably 2 to 8 wt %.

The silicon denatured polycarbonate copolymer exhibits excellent solubility with respect to conventional solvents exemplified by tetrahydrofuran, dioxane, benzene, toluene, xylene, chlorobenzene, dichlorobenzene, dichloromethane or their mixture. Moreover, it has excellent electrophotographic characteristics, product stability and quality stability.

The silicon-type graft polymer contains a polymerizable monomer having, on the side chain thereof, a silicon atom. A silicon-type graft polymer of the foregoing type can be obtained by copolymerizing the following substances (a) and (b), or (a) and (c): (a) a monomer of a type having a silicon atom on the side chain thereof and a polymerizable functional group at a terminal thereof (hereinafter called a "silicon monomer"); (b) a polymerizable monomer having no silicon atom; (c) a macromonomer comprising a polymer having a relatively low molecular weight, the polymer having no silicon atom but having a polymerizable functional group at a terminal thereof. The silicon-type graft polymer has a structure in which the side chain containing silicon hangs from the main chain. It is preferable that the number average molecular weight of the macromonomer be 1000 to 10,000. It should be noted that the number average molecular weight is a value obtained by employing a GPC (Gel Permeation Chromatography) method.

The silicon-type graft polymer can be polymerized by radical polymerization or by ion polymerization, such as solution polymerization, suspension polymerization, and bulk polymerization and the like. Among the foregoing methods, it is preferable that the radical polymerization be performed by solution polymerization.

Preferred examples of the silicon-type monomer will now be described.

Silicon-Type Monomer No.

(1)

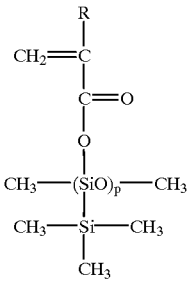

-continued (2)

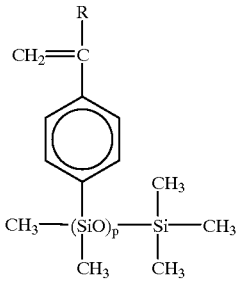

(3)

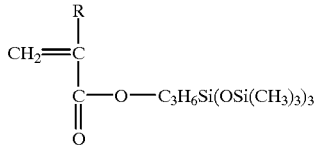

(4)

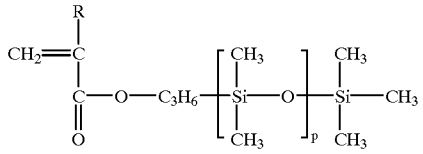

(5)

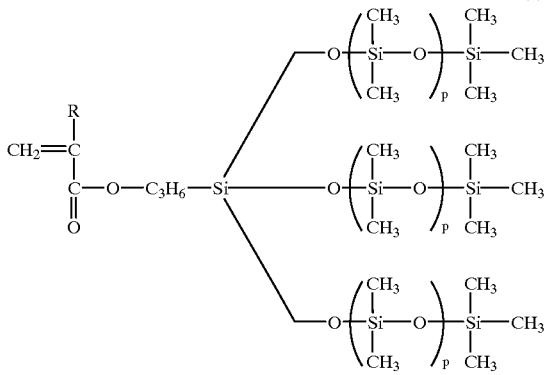

where R is a hydrogen atom or a methyl group and p is a positive integer.

The polymerizable monomer having no silicon atom or the macromonomer having no silicon atom must be selected from a group having affinity with the binder resin in the photosensitive layer or the protective layer. The polymerizable monomer is exemplified by acrylates, methacrylates and styrene macromonomers. It is preferable that the copolymerization ratio be such that the content ratio of the monomer having the silicon atom is 5 wt % or more with respect to the graft polymer. It is preferable that the molecular weight of the obtained silicon-type graft polymer be 500 to 100,000, more preferably 1,000 to 10,000 as the number average molecular weight. It is preferable that the quantity of Si atoms in the silicon-type graft polymer be 5 to 30 wt %.

It is preferred that the content of the silicon-type graft polymer be 0.02 to 10 wt % with respect to the weight of the solid component in the surface layer, more preferably 0.1 to 5 wt %. If the content is too small, no satisfactory effects are be obtained. If the content is too large, blushing sometimes takes place and/or residual charges are sometimes accumulated.

The silicon-type graft polymer according to the present invention exhibits excellent compatibility with the binder resin in the surface layer if a monomer to be copolymerized is selected adequately. Therefore, the coating film obtained exhibits excellent transparency, is free from shift or from oozing out onto the surface layer and has effect continuity. Since the silicon atom on the side chain faces the interface, the surface quality can be modified even if the quantity is very small. Further, a structure in which the silicon-type graft polymer is contained in the surface layer causes stable charging characteristics to be obtained without the accumulation of the residual charges due to the repetitive electrophotographic process.

The surface layer containing the silicon denatured polycarbonate copolymer and the silicon-type graft polymer has significantly improved lubricity without deterioration of its electric and mechanical characteristics. Therefore, excess toner does not remain on the photosensitive member, and, accordingly, the necessity of cleaning the photosensitive member can be eliminated. However, if desired the photosensitive member may be cleaned to completely remove any residual toner on the photosensitive member.

Since the silicon denatured polycarbonate copolymer and the silicon-type graft polymer have affinity, the lubricity of the electrophotographic photosensitive member can be maintained for a long time.

The electrophotographic photosensitive member according to the present invention may comprise a photosensitive layer in the form of a so-called single layer in which charge generating substances and charge transporting substances are contained in the same layer or a multi-layer or stacked layer in which a charge generating layer containing the charge generating substances and the charge transporting layer containing the charge transporting substances are laminated. In order to satisfy the various characteristics required for the electrophotographic photosensitive member, it is preferable that the laminated-type electrophotographic photosensitive member be employed.

Preferred charge generating substances are exemplified by an azo pigment, a quinone pigment, a quinocyanic pigment, a perylene pigment, an indigo pigment, an azulenium salt pigment, a copper phthalocyanine, selenium-tellurium, a pyrylium pigment and a thiopyrylium pigment. If the photosensitive layer is in the form of a stacked layer, the charge generating layer is formed by vacuum evaporation or by a method comprising the steps of sufficiently dispersing the charge generating substances together with a bonding resin and a solvent by means of a homogenizer, ultrasonic waves, a ball mill, an oscillation ball mill, a sand mill, an attrition mill or a roll mill and applying and drying the same. It is preferred to provide the ratio of the charge generating layer and the binder resin to be from 1:5 to 5:1, more preferably 1:2 to 3:1. The thickness of the charge generating layer is 5 $\mu$m or less, preferably 0.05 to 2 $\mu$m.

A preferred charge transporting substance is exemplified by a polycyclic aromatic compound, such as biphenylene, anthracene, pyrene or phenanthrene, a nitrogen-containing cyclic compound, such as indole, carbazole, oxadiazole or pyrazoline, a hydrazone compound and a styryl compound.

If the photosensitive layer is in the form of a stacked layer, the charge transporting layer can be formed by dissolving the charge transporting substances with the binder resin in a solvent and by applying and drying the same. The ratio of the charge transporting substances and the binding resin is from 3:1 to 1:3 in weight, preferably 2:1 to 1:2. The thickness of the charge transporting layer is from 5 to 40 $\mu$m, preferably 10 to 30 $\mu$m.

If the photosensitive layer is in the form of a single layer, it can be formed by applying a solution which contains the foregoing charge generating substances and the charge transporting substances dispersed in the binding resin by using a solvent and by drying the applied solution.

As for the binding resin in the photosensitive layer, the following substances may be employed in the layer, except the outer surface: polyvinyl butyral, polyvinylbenzal, polyarylate, polycarbonate, polyester, phenoxy resin, cellulose resin, acrylic resin, polyurethane, acrylonitrile-styrene copolymer, polyacrylamide, polyamide or chlorinated rubber.

A preferred binder resin in the charge generating layer is exemplified by polyvinyl butyral, polyvinyl benzal, polyarylate, polycarbonate, polyester, phenoxy resin, cellulose resin, acrylic resin and polyurethane. A preferred binder resin for the charge transporting substances is exemplified by acrylic resin, polyarylate, polyester, polycarbonate, polystyrene, acrylonitrile-styrene copolymer, polyacrylamide, polyamide and chlorinated rubber.

It is preferable that the binder resin in the outer surface be a polycarbonate polymer having a structure expressed by general formula (II). general formula (II)

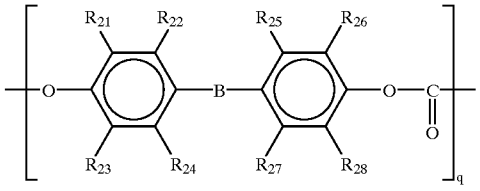

where B is a straight chain, branched chain or cyclic alkylidene group, an aryl-substituted alkylidene group, a substituted or unsubstituted arylene dialkylidene group, —O—, —S—, —CO—, —SO— or —$SO_2$—, $R_{21}$ to $R_{28}$ are each hydrogen, halogen, a substituted or unsubstituted alkyl group, a substituted or unsubstituted alkenyl group or a substituted or unsubstituted aryl group, and q is a positive integer.

It is preferable that B in the general formula (II) have 1 to 15 carbon atoms. It is preferable that $R_{21}$ to $R_{28}$ have 1 to 4 carbon atoms. It is preferred that the molecular weight of the polycarbonate polymer having the structure expressed by general formula (II) be, in viscosity average molecular weight, 5,000 to 150,000, more preferably 10,000 to 100,000.

Preferred examples of the polycarbonate polymer having the structure expressed by general formula (II) are as follows:

Compound No.

(1)

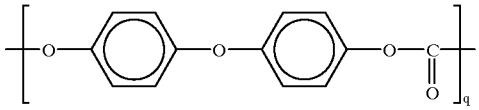

(2)

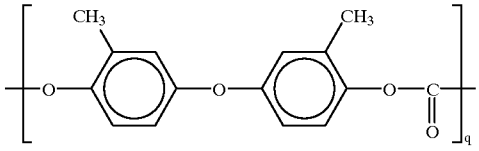

(3)

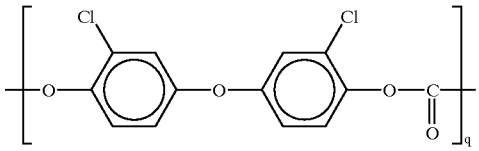

(4)

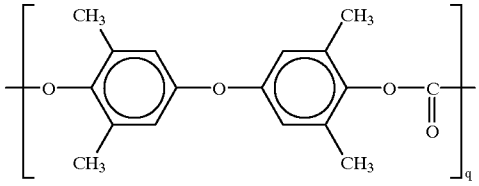

-continued
(5)
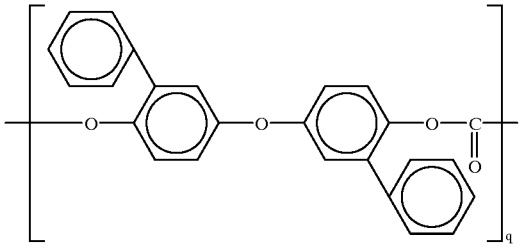
(6)
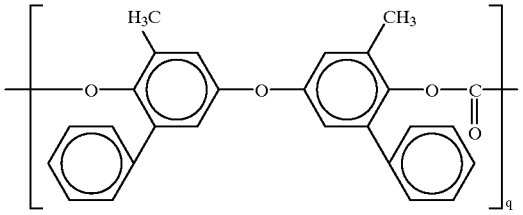
(7)
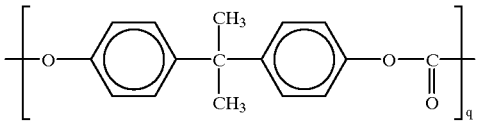
(8)
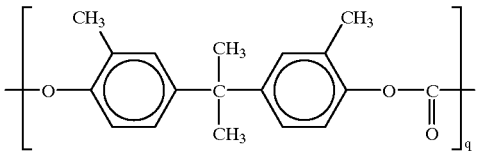
(9)
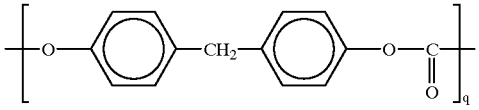
(10)
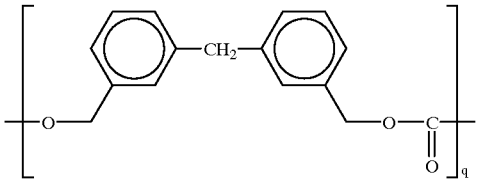
(11)
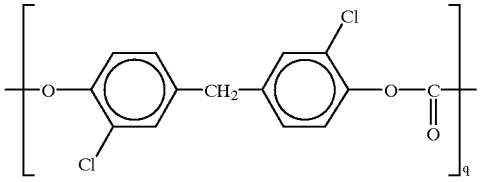
(12)
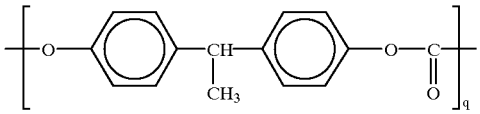

-continued
(13)
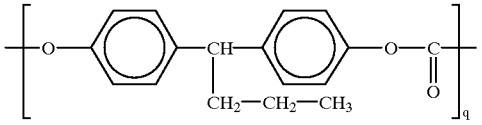
(14)
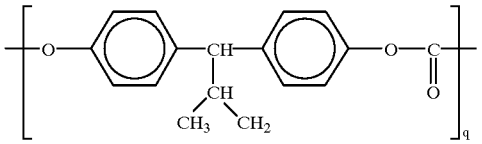
(15)
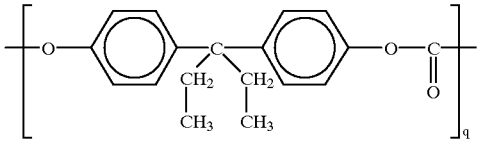
(16)
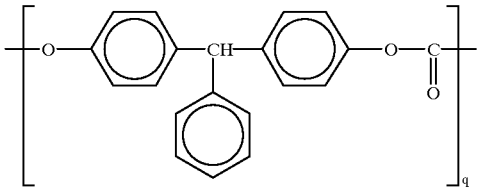
(17)
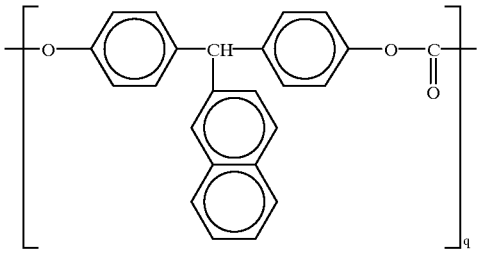
(18)
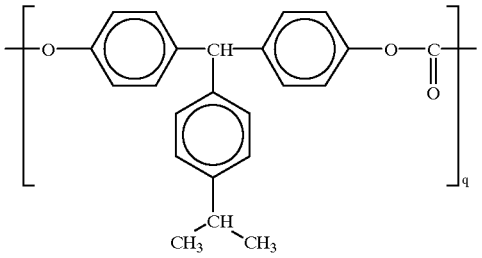
(19)
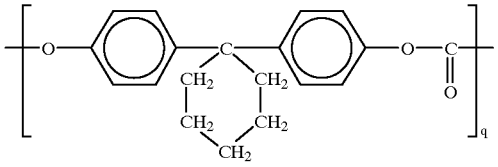

-continued (20)

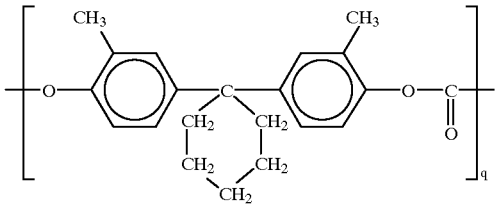

(21)

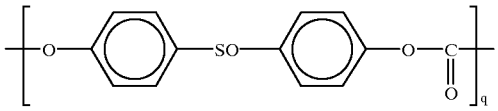

(22)

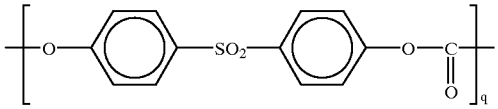

(23)

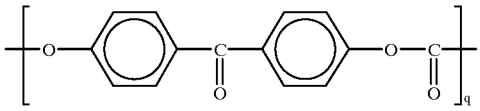

(24)

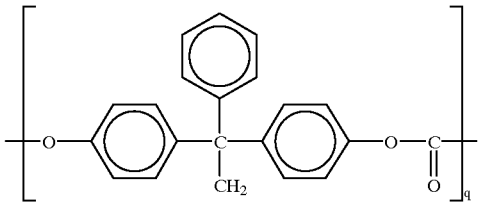

(25)

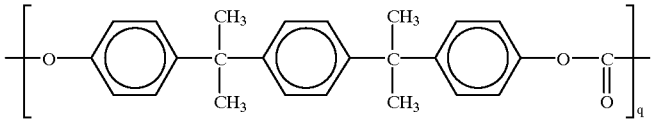

(26)

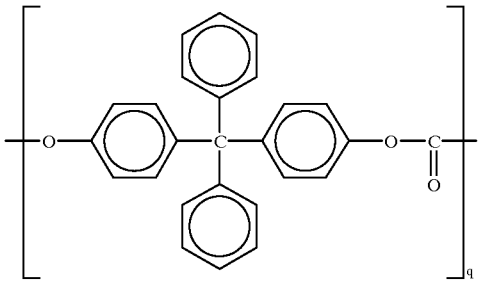

It is preferable to select any one of Compound Nos. 7, 19, 20 or 25 from the polycarbonate polymers expressed by general formula (II). In particularly, it is preferable to employ Compound No. 19.

The photosensitive layer is formed by using a solvent, such as toluene, xylene or chlorobenzene or the like by any one of the following known methods: immersion coating method, a spray coating method, a spinner coating method, a curtain coating method, a roll coating method and a gravure coating method. In order to efficiently and precisely mass-produce the drum electrophotographic photosensitive member, the optimum method is the immersion coating method.

The electrophotographic photosensitive member according to the present invention may comprise a protective layer on the photosensitive layer thereof. The protective layer may be made of polyethylene, polypropylene, polyvinylidene chloride, polystyrene, poly-α methylstyrene, polymethylmethacrylate, polycarbonate or polymethyl methacrylate/polystyrene copolymer.

The protective layer may include electroconductive elements, such as charge transporting substances or electroconductive powder, in order to lower the residual potential. The electroconductive powder is exemplified by: metal powder, scale-shape metal powder, short metal fibers of aluminum, copper, nickel or silver; electroconductive metal oxide such as antimony oxide, indium oxide or tin oxide; electroconductive polymers such as polypyrrole, polyaniline or polymer electrolyte; carbon black, carbon fibers and graphite powder.

It is preferable that the thickness of the protective layer be from about 0.2 μm to about 15 μm to realize a desired residual potential and to obtain desired durability. In order to improve the strength and the quality of the formed image, it is preferable that the protective layer is from 0.5 μm to 15 μm.

The protective layer can be formed by a coating method, such as an immersion coating method, a spray coating method or an electrostatic coating method.

The electroconductive support member of the electrophotographic photosensitive member according to the present invention may be made of an electroconductive material exemplified by aluminum, aluminum alloy, copper, zinc, stainless steel, vanadium, molybdenum, chrome, titanium, nickel, indium, gold and platinum. Further, the support member may be (1) plastic or paper having an electroconductive layer made of aluminum, aluminum alloy, indium oxide, tin oxide, indium oxide-tin oxide alloy (ITO), (2) a plastic or paper containing electroconductive particles or (3) a plastic containing electroconductive polymers.

An undercoating layer having a barrier function and a bonding function may be formed between the electroconductive support member and the photosensitive layer, if necessary. The undercoating layer may be formed by using, for example, casein, polyvinyl alcohol, nitrocellulose, ethylene-acrylic acid copolymer, polyvinyl butyral, phenol resin, polyamide, polyurethane, gelatin or aluminum oxide. It is preferable that the thickness of the undercoating layer be 0.1 to 10 μm, more preferably 0.1 to 5 μm. If the image input is performed by means of laser beams, an electroconductive layer may be formed between the electroconductive support member and the undercoating layer, if necessary, in order to prevent formation of interference fringes due to scattering. The foregoing electroconductive layer can be formed by dispersing metal particles or electroconductive powder of a metal oxide in an adequate binder resin. It is preferable that the thickness of the electroconductive layer be 5 to 40 μm, more preferably 10 to 30 μm.

The electrophotographic photosensitive member according to the present invention may be formed into a drum, sheet or endless belt without particular limitation.

The electrophotographic photosensitive member according to the present invention can widely be adapted to a conventional electrophotographic apparatus exemplified by a copying machine, a laser printer, an LED printer, a liquid crystal shutter type printer. Furthermore, it may be employed in a display, a recording apparatus, a light-load printing apparatus, a processing apparatus and a facsimile machine.

An electrophotographic apparatus having the electrophotographic photosensitive member according to the present invention will now be described.

Figure 3:
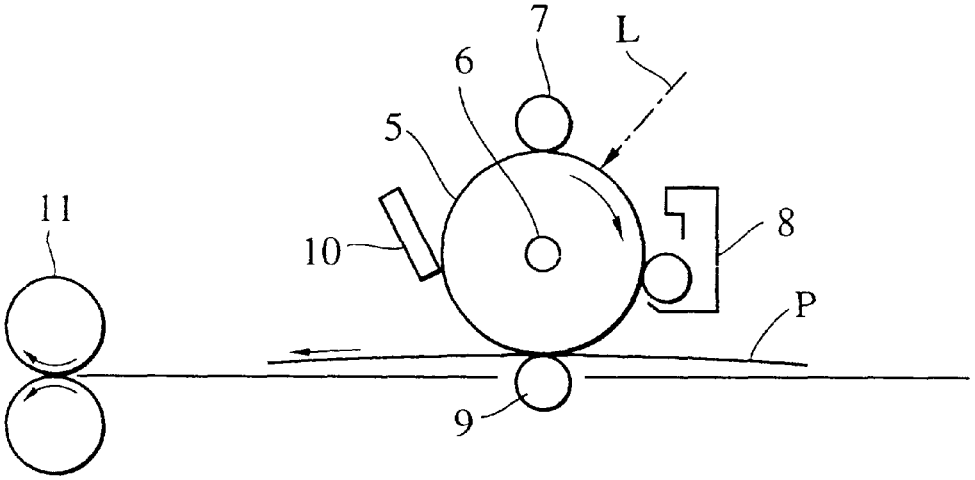
FIG. 3 is a view which illustrates an example of an image forming apparatus according to the present invention.

FIG. 3 is a schematic view which illustrates the structure of a conventional transference-type electrophotographic apparatus using a drum-type photosensitive member according to the present invention. Referring to FIG. 2, reference numeral 5 represents a drum photosensitive member according to the present invention, the drum electrophotographic photosensitive member 5 being rotated around a shaft 6 in a predetermined direction represented by an arrow at a predetermined peripheral speed.

The photosensitive member 5 is a member on which an electrostatic latent image by a latent image forming means. The latent image is formed by using a charging means 7 in the form of, for example, rollers, which positively or negatively charges the outer surface of the photosensitive member 5 to a predetermined potential and by applying optical image exposing light L (slight exposing light or laser beam scanning exposing light) by an image exposing means (omitted from illustration). As a result, electrostatic latent images corresponding to the exposed image are sequentially formed on the outer surface of the photosensitive member.

The electrostatic latent images formed by the latent image forming means are toner-developed by a developing means 8. The formed toner-developed images are, by a transference means 9 in the form of, for example, rollers, sequentially transferred to the surface of a recording member P supplied from a paper supply portion (omitted from illustration) through a space between the photosensitive member 5 and the transference means 9, the recording paper P being supplied in synchronization with the rotations of the photosensitive member 5. The recording member P caused to have the transferred image is separated from the surface of the photosensitive member 5, the recording member P being then guided to an image fixing means 11 so that the images are fixed before being printed out outside the apparatus in the form of a copy. The surface of the photosensitive member 5 after the image has been transferred as described above is cleaned by a cleaning means 10. The charging means 7 for uniformly charging the photosensitive member 5 may be a corona charging unit in place of the roller type unit. The transference unit 9 may be a corona transference means in place of the roller type transference means.

The electrophotographic apparatus may be arranged in such a manner that a plurality of components, such as the photosensitive member, the developing means and the cleaning means are integrally combined into a unit of the apparatus, the unit being made detachable from the apparatus body. For example, the photosensitive member 5 and the cleaning means 10 may be integrated into one unit of the apparatus, the unit being made detachable from the apparatus by using a guide means, such as a rail. If the electrophotographic apparatus is used as a copying machine or a printer, the optical image exposing light L may be reflected light or transmitted light. As an alternative to this, it may be performed by reading the original document to form it into a signal so as to perform scanning with laser beams in response to the foregoing signal or drive a light emitting diode or a liquid crystal shutter array.

Figure 4:
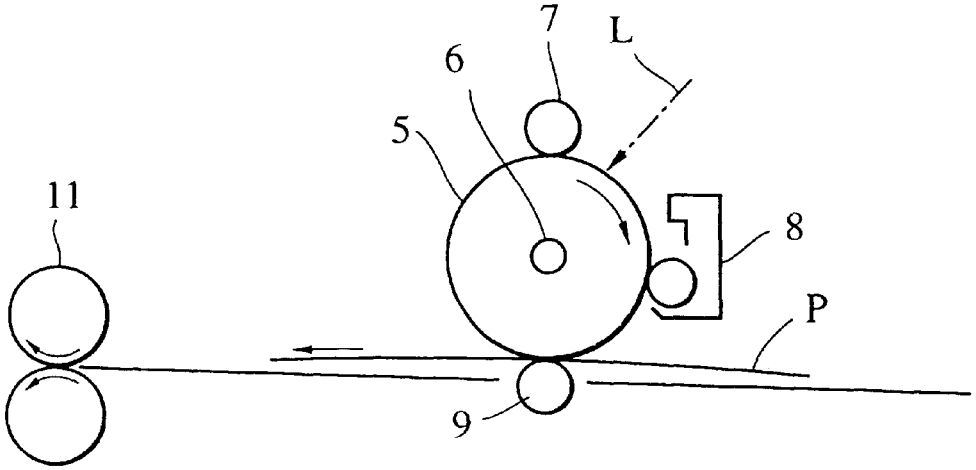
FIG. 4 is a view which illustrates another example of the image forming apparatus according to the present invention.

Since the electrophotographic apparatus according to the present invention comprises the photosensitive member 5 which exhibits excellent lubricity, an image can satisfactorily be formed even if the cleaning means 10 is omitted as shown in FIG. 4. That is, the photosensitive member according to the present invention can be used as a cleaning-less photosensitive member. This is possible because the enhanced lubricity of the surface layer substantially eliminates excess toner which tends to remain on said photosensitive member after the toner image is transferred.

EXAMPLES

The present invention will now be described by providing examples. In the descriptions below, parts means parts by weight and % means wt %.

In the following Examples, the Samples I to IV were used as silicon-type graft polymer.

Sample I is a copolymer of silicon monomer (in the structural formula of which R is a methyl group and p is 20) No. 1 and styrene, Sample I containing 30% of the silicon monomer.

Sample II is a copolymer of silicon monomer (in the structural formula of which R is a methyl group and p is 30) No. 2 and styrene, Sample II containing 50% of the silicon monomer.

Sample III is a copolymer of silicon monomer (in the structural formula of which R is a methyl group and p is 30) No. 1 and the MMA macromonomer, Sample III containing 30% of the silicon monomer.

Sample IV is a copolymer of silicon monomer (in the structural formula of which R is a methyl group and p is 5) No. 5 and the MMA macromonomer, Sample IV containing 30% of the silicon monomer.

Example 1

50 parts of electroconductive titanium oxide powder covered with tin oxide containing 10% antimony oxide, 25 parts of phenol resin, 20 parts of methyl cellosolve, 5 parts of methanol and 0.002 parts of silicone oil (polydimethylsiloxane polyoxyalkylene copolymer, trade name "SH28PA" manufactured by Toray Silicon) were dispersed in a sand mill apparatus using glass beads, each having a diameter of 1 mm, for two hours, so that an electroconductive paint was prepared. The thus-prepared paint was applied onto an aluminum sheet by using a wire bar, and was dried at 140° C. for 30 minutes, so that a electroconductive layer having a thickness of 20 μm was formed.

Then, 5 parts of N-methoxymethylated nylon was dissolved in 95 parts of methanol, so that paint for an undercoating layer was prepared. The paint was applied to the upper surface of the electroconductive layer, and was dried at 100° C. for 20 minutes, so that an undercoating layer having a thickness of 0.6 μm was formed.

Then, 3 parts of disazo pigment having a structure expressed by the following structural formula, 2 parts of polyvinylbenzal (ratio of benzaldehyde was 80% and weight average molecular weight was 11,000) and 35 parts of cyclohexane were dispersed in a sand mill apparatus using glass beads, each having a diameter of 1 mm, for 12 hours. Then, 60 parts of methyl ethyl ketone were added, so that paint for a charge generating layer was prepared. The paint was applied to the upper surface of the undercoating layer by using a wire bar, and was dried at 80° C. for 20 minutes, so that a charge generating layer having a thickness of 0.2 μm was formed.

Then, 10 parts of styryl compound having a structure expressed by the following structural formula, 10 parts of a polycarbonate polymer (viscosity average molecular weight was $2.05\times10^4$) and 1 part of silicon denatured polycarbonate copolymer (viscosity average molecular weight was $2.10\times10^4$) having a structure expressed by the following structural formula were dissolved in a mixture solvent of 20 parts of dichloromethane and 40 parts of chlorobenzene. Then, 0.2 parts of silicon-type graft polymer (sample No. I) was added to the foregoing liquid, so that a solution was prepared. The solution was applied to the upper surface of the charge generating layer by using a wire bar. Then, the solution was dried at 120° C. for 60 minutes, so that a charge transporting layer having a thickness of 18 μm was formed. Thus, an electrophotographic photosensitive member was formed.

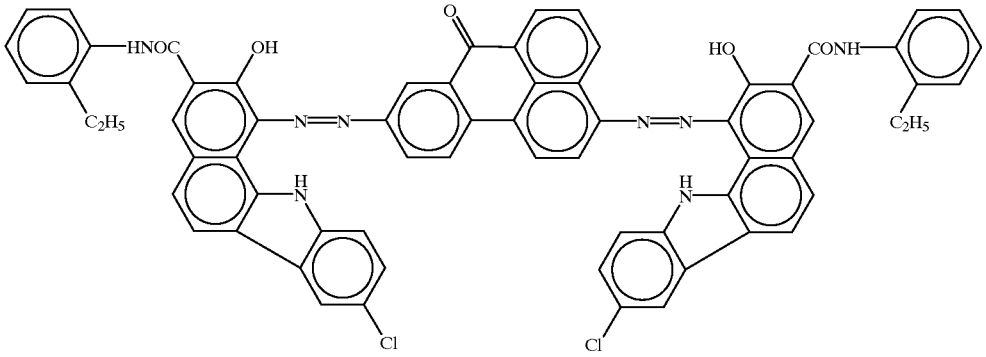

Stryl compound

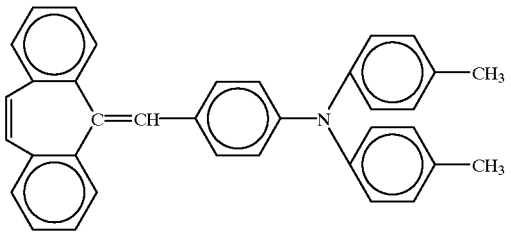

Polycarbonate polymer

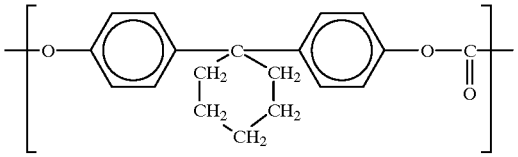

Silicon denatured polycarbonate copolymer

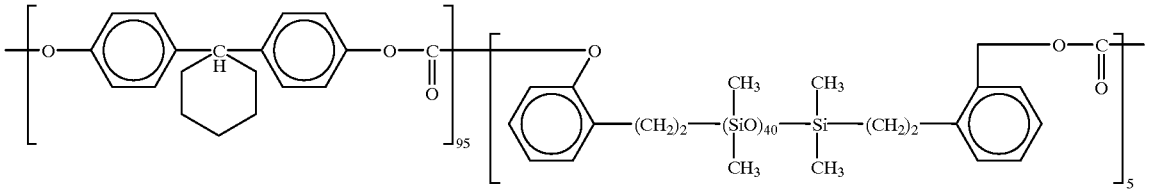

The thus-made electrophotographic photosensitive member was subjected to a rotary taper wear resistance test. As a result, no weight reduction was observed even after it was worn down 1,000 times under a load of 500 g. Thus, significantly satisfactory wear resistance was exhibited. The sliding resistance of the electrophotographic photosensitive member with respect to a urethane cleaning blade was measured when a load of 10 g was applied by using a surface characteristics testing apparatus (HEIDONN-14 manufactured by Shinto). As a result, an output of 60 mV was read from a chart recorder. It should be noted that the output value from the chart recorder is in proportion to a small sliding resistance, which represents improved lubricity.

Example 2

An electrophotographic photosensitive member was manufactured and evaluated similarly to Example 1 except that a copolymer (viscosity average molecular weight was $2.07\times10^4$) having a structure expressed by the following formula was used in place of the copolymer used in Example 1. The results are shown in Table 1.

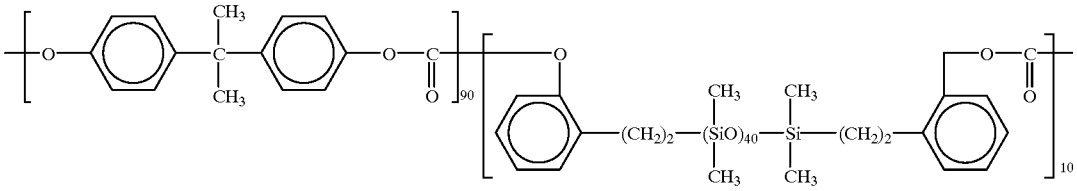

Example 3

An electrophotographic photosensitive member was manufactured and evaluated similarly to Example 1 except that a copolymer (viscosity average molecular weight was $3.05\times10^4$) having a structure expressed by the following formula was used in place of the silicon denatured polycarbonate copolymer and the silicon-type graft polymer used in Example 1. The results are shown in Table 1.

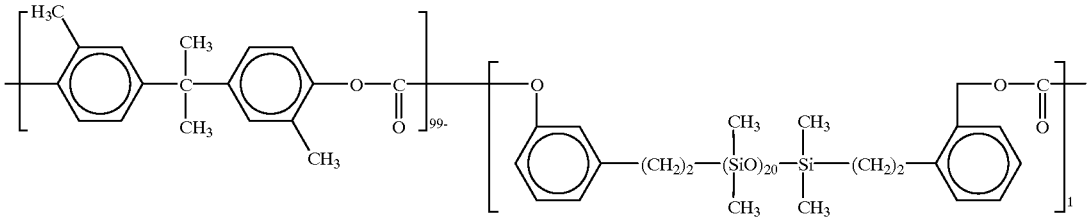

Example 4

An electrophotographic photosensitive member was manufactured and evaluated similarly to Example 1 except that a copolymer (viscosity average molecular weight was $4.05\times10^4$) having a structure expressed by the following formula and silicon-type graft polymer (sample No. II) were used in place of the silicon denatured polycarbonate copolymer and the silicon-type graft polymer used in Example 1. The results are shown in Table 1.

Example 6

An electrophotographic photosensitive member was manufactured and evaluated similarly to Example 1 except that disazo pigment, a hydrazone compound each of which had a structure expressed by the following formula, a copolymer (viscosity average molecular weight was $2.10\times10^4$) and silicon-type graft polymer (sample No. IV) were used in place of the charge generating substance, the charge transporting substance, the silicon denatured polycarbonate copolymer and the silicon-type graft polymer used in Example 1. The results are shown in Table 1.

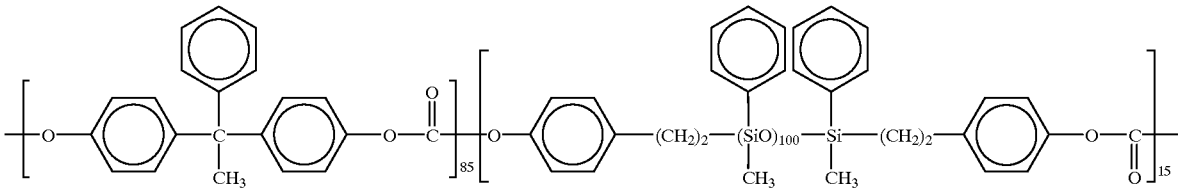

Example 5

An electrophotographic photosensitive member was manufactured and evaluated similarly to Example 1 except that a copolymer (viscosity average molecular weight was $2.03\times10^4$) having a structure expressed by the following formula and silicon-type graft polymer (sample No. III) were used in place of the silicon denatured polycarbonate copolymer and the silicon-type graft polymer used in Example 1. The results are shown in Table 1.

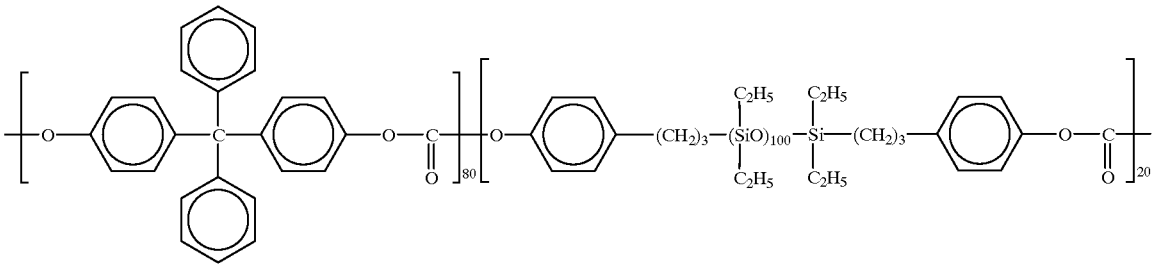

Disazo Pigment

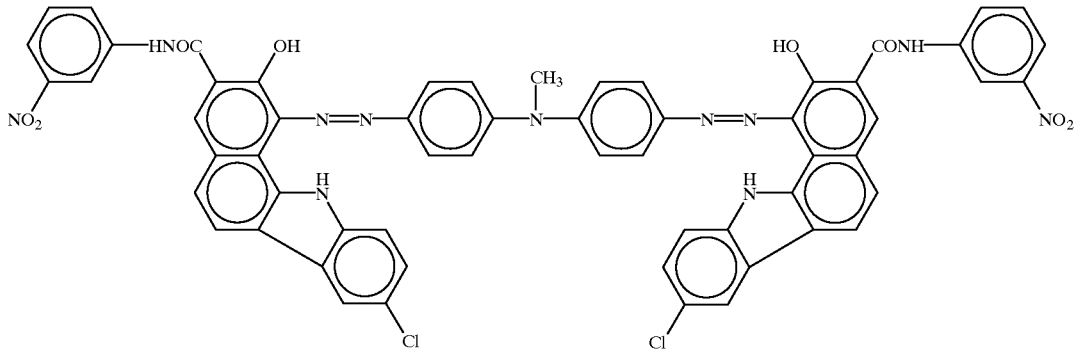

Hydrazone Compound

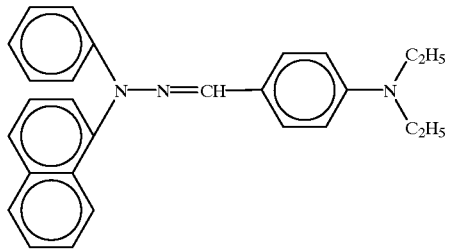

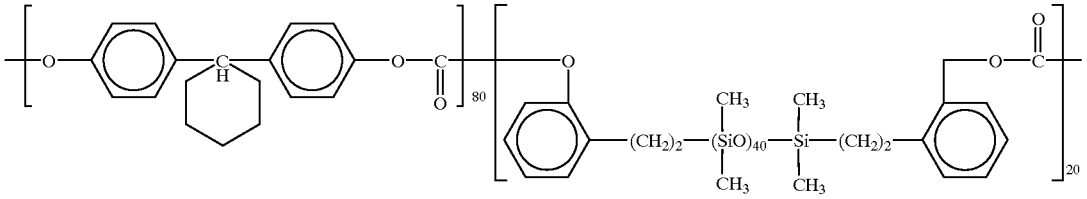

Example 7

An electrophotographic photosensitive member was manufactured and evaluated similarly to Example 1 except that a copolymer (viscosity average molecular weight was $2.30\times10^4$) having a structure expressed by the following formula was used in place of the silicon denatured polycarbonate copolymer used in Example 1. The results are shown in Table 1.

Example 8

An electrophotographic photosensitive member was manufactured and evaluated similarly to Example 1 except that a copolymer (viscosity average molecular weight was $2.15\times10^4$) having a structure expressed by the following formula was used in place of the silicon denatured polycarbonate copolymer used in Example 1. The results are shown in Table 1.

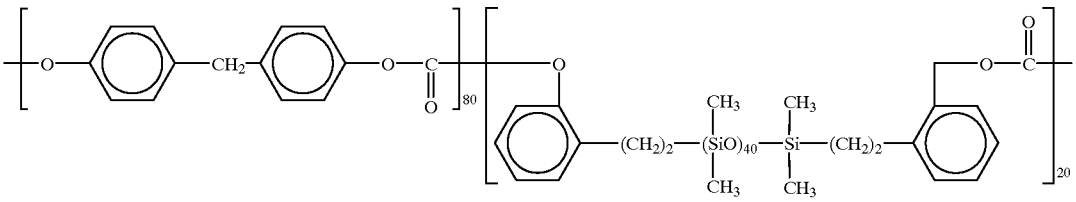

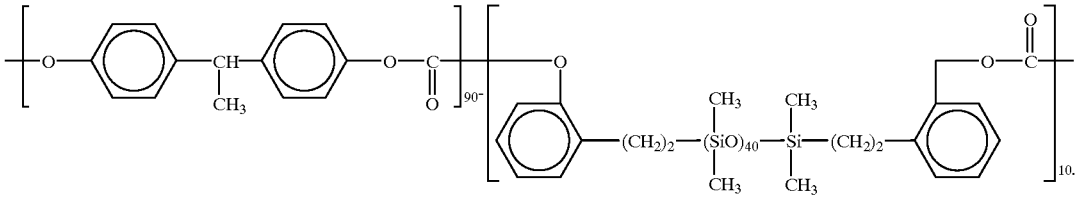

Example 9

An electrophotographic photosensitive member was manufactured and evaluated similarly to Example 1 except that a copolymer (viscosity average molecular weight was $3.03\times10^4$) having a structure expressed by the following formula was used in place of the silicon denatured polycarbonate copolymer used in Example 1. The results are shown in Table 1.

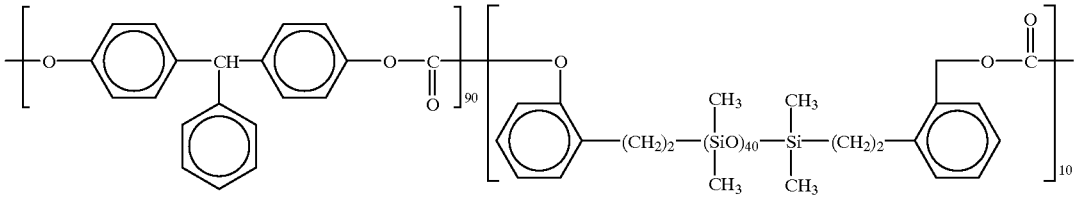

Example 10

An electrophotographic photosensitive member was manufactured and evaluated similarly to Example 1 except that a copolymer (viscosity average molecular weight was $4.01\times10^4$) having a structure expressed by the following formula was used in place of the silicon denatured polycarbonate copolymer used in Example 1. The results are shown in Table 1.

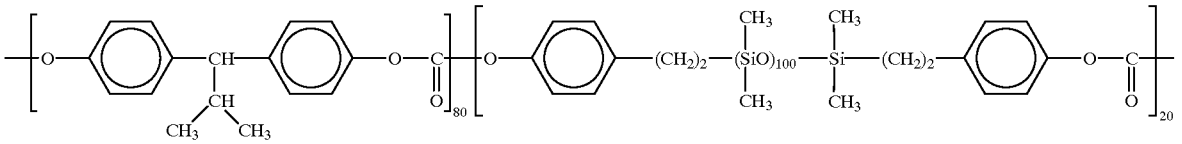

Example 11

An electrophotographic photosensitive member was manufactured and evaluated similarly to Example 1 except that a copolymer (viscosity average molecular weight was $5.23\times10^4$) having a structure expressed by the following formula was used in place of the silicon denatured polycarbonate copolymer used in Example 1. The results are shown in Table 1.

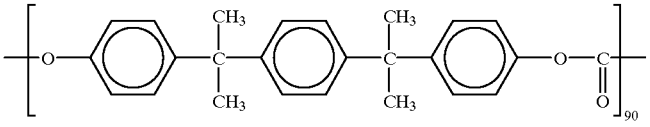

-continued

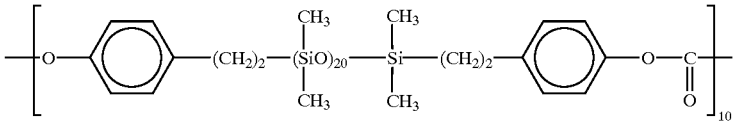

Comparative Example 1

An electrophotographic photosensitive member was manufactured and evaluated similarly to Example 1 except that a copolymer (viscosity average molecular weight was $2.2\times10^4$) having a structure expressed by the following formula was used in place of the silicon denatured polycarbonate copolymer used in Example 1 and the silicon-type graft polymer was omitted. The results are shown in Table 1.

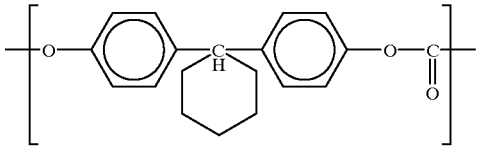

Comparative Example 2

An electrophotographic photosensitive member was manufactured and evaluated similarly to Example 1 except that a copolymer (viscosity average molecular weight was $1.45\times10^4$) having a structure expressed by the following formula was used in place of the copolymer used in Example 1, dichloromethane was used as the solvent and the silicon-type graft polymer was omitted. The results are shown in Table 1.

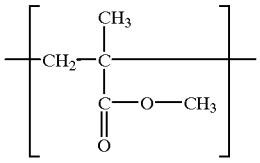

TABLE 1

| | Quantity of Wear (mg) | Sliding Resistance (mV) |
|---|---|---|
| Example 1 | 0.00 | 60 |
| Example 2 | 0.01 | 90 |
| Example 3 | 0.04 | 120 |
| Example 4 | 0.01 | 95 |
| Example 5 | 0.00 | 90 |
| Example 6 | 0.02 | 80 |
| Example 7 | 0.04 | 90 |
| Example 8 | 0.03 | 105 |
| Example 9 | 0.01 | 90 |
| Example 10 | 0.02 | 85 |
| Example 11 | 0.00 | 80 |
| Comparative Example 1 | 2.15 | 380 |
| Comparative Example 2 | 3.87 | 530 |

Example 12

An electrophotographic photosensitive member was manufactured similarly to Example 1 except that the thickness of the undercoating layer was 0.9 $\mu$m, the charge transporting substances comprised the following styryl compound having a structure expressed by the following formula and the quantity of the silicon-type graft polymer (Sample No. 1) was 0.8 parts.

Styryl Compound

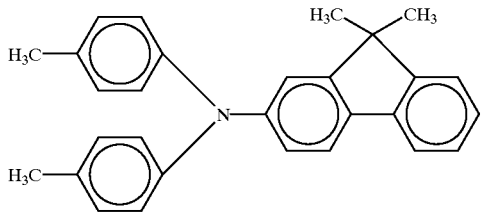

The thus-manufactured electrophotographic photosensitive member was mounted on a color electrophotographic apparatus having no cleaning means to repeatedly form images. As a result, clear images were formed in such a manner that no residual toner stuck to the upper surface of the photosensitive member even after 10,000 sheets of image forming operations had been completed.

Example 13

An electrophotographic photosensitive member was manufactured similarly to Example 1 except that a polymer (viscosity average molecular weight was $1.45\times10^5$) having a structure expressed by the following structural formula was used in place of the copolymer used in Example 1, dichloromethane was used as the solvent and no silicon-type graft polymer was present.

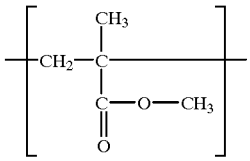

Then, 5 parts of the silicon denatured polycarbonate copolymer and 0.5 parts of the silicon-type graft polymer, which were the same as those of Example 1, were dissolved in 95 parts of chlorobenzene, so that paint for the protective layer was prepared. The paint for the protective layer was applied by spraying to the photosensitive layer of the foregoing electrophotographic photosensitive member and dried at 120° C. for 60 minutes, so that a protective layer having a thickness of 2.5 $\mu$m was formed.

The thus-manufactured electrophotographic photosensitive member was mounted on a color electrophotographic apparatus having a cleaning means to repeatedly form images. As a result, no deterioration in the image quality nor did any inversion of the cleaning blade take place even after 10,000 sheets of image forming operations had been performed.

Example 14

2 parts of fine powder of tin oxide, 10 parts of the silicon denatured polycarbonate copolymer according to Example 1 and 0.5 parts of silicon-type graft polymer were dissolved in 100 parts of chlorobenzene, so that paint for the protective layer was prepared.

Then, an electrophotographic photosensitive member was manufactured similarly to Example 13 except that the foregoing paint for the protective layer was used in place of that according to Example 13.

The thus-manufactured electrophotographic photosensitive member was used to form images similarly to Example 12. As a result, no image deterioration was observed even after 10,000 sheets of image formation operation had been performed.

Example 15

5 parts of charge transporting substances having a structure expressed by the following structural formula, 10 parts of the silicon denatured polycarbonate copolymer according to Example 1 and 0.5 parts of silicon-type graft polymer were dissolved in 100 parts of chlorobenzene, so that paint for the protective layer was prepared.

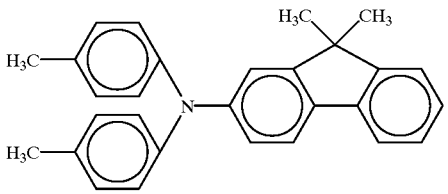

Then, an electrophotographic photosensitive member was manufactured similarly to Example 13 except an arrangement that the foregoing paint for the protective layer was used in place of that according to Example 13.

The thus-manufactured electrophotographic photosensitive member was used to form images similarly to Example 13. As a result, excellent surface lubricity was exhibited and no image deterioration and inversion of the cleaning blade took place even after 10,000 sheets of image formation operation had been performed.

Although the invention has been described in its preferred form with a certain degree of particularly, it is understood that the present disclosure of the preferred form can be changed in the details of construction and the combination and arrangement of parts may be resorted to without departing from the spirit and the scope of the invention as hereinafter claimed.

What is claimed is:

1. An electrophotographic photosensitive member comprising, in sequence:

(a) an electroconductive support; and (b) a photosensitive layer wherein an outer surface of said photosensitive member contains a binder resin, a silicon denatured polycarbonate copolymer present in amounts from 1 to 30% by weight based on the weight of said binder resin and a silicon-containing graft polymer present in amounts from 0.02 to 10% by weight based on the weight of solids in the outer surface, wherein said silicon denatured polycarbonate copolymer has a structure of the following formula (I):

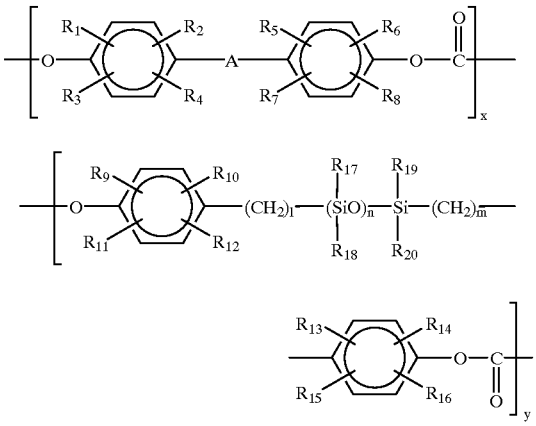

wherein A is a straight chain, branched chain or cyclic alkylidene group, an aryl-substituted alkylene group, a substituted or unsubstituted arylene group, —O—, —S—, —SO—, —$SO_2$—, or —CO—, $R_1$ to $R_{16}$ are hydrogen atoms, halogen atoms, substituted or unsubstituted alkyl groups, or substituted or unsubstituted aryl groups, $R_{17}$ to $R_{20}$ are substituted or unsubstituted alkyl groups or substituted or unsubstituted phenyl groups, l, m and n are integers larger than 1, and the sum of X and Y is 100 wherein X:Y is from 99.5:0.5 to 10:90 and wherein said silicon-containing graft polymer includes, as a component thereof, a polymerizable monomer incorporating a side chain having a silicon atom.

2. An electrophotographic photosensitive member according to claim 1, wherein the molecular weight of said silicon denatured polycarbonate copolymer is 5,000 to 150,000 based on viscosity average molecular weight.

3. An electrophotographic photosensitive member according to claim 1, wherein said silicon-containing graft polymer contains Si atoms in a quantity of 5 to 30 wt %.

4. An electrophotographic photosensitive member according to claim 1, wherein the molecular weight of said silicon-containing graft polymer is 500 to 100,000 based on number average molecular weight.

5. An electrophotographic photosensitive member according to claim 1, wherein said photosensitive layer is a laminate of a charge generating layer and a charge transporting layer.

6. An electrophotographic photosensitive member according to claim 1, wherein said photosensitive layer contains a polycarbonate binder resin, said polycarbonate having a structure of the following formula (II)

(II)

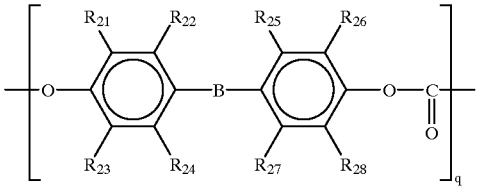

wherein where B is a straight chain, branched chain or cyclic alkylidene group, an aryl-substituted alkylidene group, a substituted or unsubstituted arylene dialkylidene group, —O—, —S—, —CO—, —SO— or —$SO_2$—, $R_{21}$ to $R_{28}$ are each hydrogen, halogen, a substituted or unsubstituted alkyl group, a substituted or unsubstituted alkenyl group, a substituted or unsubstituted aryl group and q is a positive integer.

7. An electrophotographic photosensitive member according to claim 8, wherein said polycarbonate polymer has a structure of the following formula:
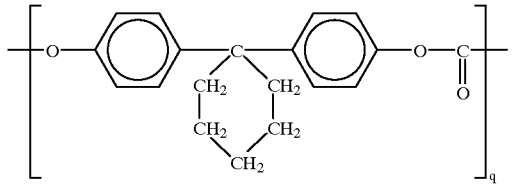
* * * * *

UNITED STATES PATENT AND TRADEMARK OFFICE

CERTIFICATE OF CORRECTION

PATENT NO. : 6,040,099
DATED : March 21, 2000
INVENTOR(S) : Nobuyuki Hanami et al.

It is certified that error appears in the above-identified patent and that said Letters Patent is hereby corrected as shown below:

Column 3,
Line 49, "alkylene" should read -- alkylidene --.

Column 29,
Line Ex. 8,

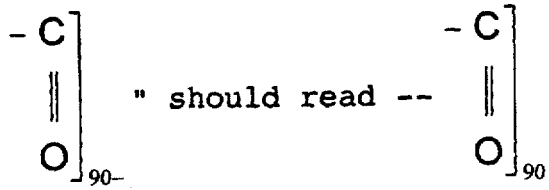

Column 34,
Line 48, "formula (II)" should read -- formula (II) : --

Column 35,
Line 2, "claim 8," should read -- claim 6, --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*